US007150952B2

(12) United States Patent
Matsushima et al.

(10) Patent No.: US 7,150,952 B2
(45) Date of Patent: Dec. 19, 2006

(54) TONER FOR DEVELOPING ELECTROSTATIC IMAGE AND PRODUCING METHOD THEREFOR

(75) Inventors: Asao Matsushima, Hino (JP); Hiroshi Yamazaki, Hachioji (JP); Ken Ohmura, Hachioji (JP); Eiichi Yoshida, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 141 days.

(21) Appl. No.: 10/787,717

(22) Filed: Feb. 26, 2004

(65) Prior Publication Data

US 2004/0175639 A1 Sep. 9, 2004

(30) Foreign Application Priority Data

Mar. 5, 2003 (JP) ..... 2003-058325
Mar. 6, 2003 (JP) ..... 2003-059758

(51) Int. Cl.
*G03G 9/08* (2006.01)

(52) U.S. Cl. ..... 430/108.1; 430/108.4; 430/108.6; 430/109.4

(58) Field of Classification Search ..... 430/108.1, 430/108.4, 108.6, 109.4
See application file for complete search history.

(56) References Cited

U.S. PATENT DOCUMENTS 6,395,445 B1 * 5/2002 Toth et al. ..... 430/137.14

FOREIGN PATENT DOCUMENTS

JP 2002-296839 10/2002
JP 2002-351140 12/2002

* cited by examiner

*Primary Examiner*—Mark A. Chapman
(74) *Attorney, Agent, or Firm*—Lucas & Mercanti, LLP

(57) ABSTRACT

A toner for developing an electrostatic image is disclosed. The toner particles containing a binder resin containing a polyester resin or a polyol resin and a colorant, and the toner particles contain aluminum in an amount of 0.007 to 0.140% by weight, chlorine in an amount of 0.002 to 0.412% by weight, and the toner particles have an average circular degree of 0.94 to 0.99 and an average circle equivalent diameter of from 2.6 to 7.4 μm.

17 Claims, 2 Drawing Sheets

TONER FOR DEVELOPING ELECTROSTATIC IMAGE AND PRODUCING METHOD THEREFOR

FIELD OF THE INVENTION

The present invention relates to a toner for developing an electrostatic image to be applied for image formation by an electrophotographic method and a method for producing the toner.

BACKGROUND OF THE INVENTION

Recently, the main stream of the image formation by the electrophotography is changed to digital system. In the image formation by the digital system, a small diameter toner for developing electrostatic image, hereinafter also referred to as the toner, is essential by which excellent fine line reproducibilty and high resolution can be realized since in such the system a small dot image of 1200 dpi level (dpi is dot number per inch, one inch is 2.54 cm) is developed.

As examples of producing method of such the small diameter toner, Japanese Patent Publication Open for Public Inspection, hereinafter referred to as JP O.P.I. Publication, Nos. 2002-296839 (Patent Publication 1) and 2002-351140 (Patent Publication 2) disclose a method by which materials of toner such as polyester or polyol resin and others are emulsified in an aqueous medium and particles thereof dispersed in the emulsion are aggregated.

As an embodiment of the digital image formation, an image formation method by a print-on-demand system is developed by which required number of image is printed at a demanded time. The image formation by such the system is noted as an important image forming method for replacing to usual light printing system since the plate making in the usual printing system is not necessary and publication of several hundreds copies and making of direct mails or invitation cards while changing the address are made possible by such the system.

A problem has been found, however, in the course of the printing of the mails or the invitation cards while changing the address by the electrophotographic image formation. The problem is that sufficient fixing cannot be performed when the image formation is carried out on a thick paper such as a thick post card and a social invitation card. Particularly, on a card having a gray colored frame relating funeral, the fixing at the part of gray frame is difficultly performed and the unfixed toner causes contamination of hands and paper surfaces.

Moreover, the toner particles tend to be crushed and thus formed fine toner particles cause the contamination of paper surface since a large load is applied onto the toner particles when the toner image is formed on the surface of thick paper which is not comparable to the load when the image is formed on thin paper such as paper for usual copying.

The thick paper such as the post card is one of the image receiving materials with the highest difficulty. Furthermore, it is necessary for spreading the electrophotographic system as the image forming method for the print-on-demand that the image can be stably formed on offset printing paper with high smoothness, not on the usual paper developed for the image receiving material for electrophotographic use. The method can difficultly accepted by the printing industry field without satisfaction of such the requirement.

It is frequently seen in a train that a commuter reads a paperback holding on his one hand while holding onto a trap by another hand. The printed paper is required to have slipping ability satisfactory for turning over leaves of the book by the one hand and the toner is required to have fixing strength so that the toner does not contaminate the paper and characters by friction.

However, the spreading of the method is late since the slipping ability and the fixing strength of the toner image by the electrophotographic method are inferior to those of the usual printing material and are not accepted by publishers. These problems cannot be solved by the use of the toners disclosed in the foregoing Patent Publications 1 and 2.

A problem so called toner blister that a white grain like image defect is formed at the high density portion of the toner image when the toner obtained through the washing process disclosed in Patent Publications 1 and 2. Such the phenomenon is apparent when the small particle toner having an average diameter of not more than 7.4 μm is used. Particularly, such the tendency is made notable when the printing is continuously repeated by 100,000 or more times or the printing is continuously carried out under a low temperature condition. It is supposed that the moisture contained in an impurity such as an aggregating agent remaining on the toner particle surface is changed to steam by heating in the fixing process and discharged so that such the image defect is caused by breaking of the toner layer by discharging of the steam.

For removing the aggregation agent remaining on the toner particle surface, a treatment using an acid or an acid and alkali has been tried. However, both of the methods were insufficient.

Any washing technique for completely remove the impurity from the toner particle surface by mechanical means is not established yet.

Patent Publication 1

JP O.P.I. Publication No. 2002-296839 (Paragraph 0011)

Patent Publication 2

JP O.P.I. Publication No. 2002-351140 (Paragraph 0011)

SUMMARY OF THE INVENTION

The object of the invention is to provide a toner and a producing method therefor which shows good fixing ability when the image is formed on an extreme thick image receiving material and high resistivity to rubbing when the image is formed on paper with high smoothness, and the toner blister is inhibited, when the toner image is formed on the image receiving material and fixed by heating.

The present invention and its embodiments are described.

1. A toner for developing an electrostatic image comprising toner particles containing a colorant and a binder resin containing a polyester resin or a polyol resin, wherein the toner particles contain an aluminum compound and a chlorine compound, a content of aluminum in the aluminum compound being from 0.007 to 0.140% by weight as an aluminum atom based on the total weight of the toner particles, and a content of chlorine in the chlorine compound being from 0.002 to 0.412% by weight based on the total weight of the toner particles, and the toner particles have an average circular degree of from 0.94 to 0.99 and an average circle equivalent diameter of from 2.6 to 7.4 μm.

2. The toner for developing an electrostatic image described in 1, wherein the content of aluminum in the aluminum compound is from 0.012 to 0.115% by weight based on the total weight of the toner particles.

3. The toner for developing an electrostatic image described in 1, wherein the content of chlorine in the chlorine compound is from 0.003 to 0.064% by weight based on the total weight of the toner particles.

4. The toner for developing an electrostatic image described in 1 or 2, wherein the toner particles contain a sodium compound, a content of sodium in the sodium compound being from 0.002 to 0.074% by weight based on the total weight of the toner particles.

5. The toner for developing an electrostatic image described in 1 through 4, wherein the inclination of the circular degree to a circle equivalent diameter of the toner particle is from −0.050 to −0.010.

6. The toner for developing an electrostatic image described in 1 through 5, wherein the toner further comprises particles of silica or titanium oxide having a primary particle diameter of from 50 to 200 nm.

7. The toner for developing an electrostatic image described in 1 through 6, wherein the binder resin comprises an amorphous polyester resin.

8. A producing method of the toner described above, which comprises;

aggregating polyester resin particles or polyol resin particles dispersed in an aqueous medium by employing an aluminum compound.

9. The producing method described in 8, wherein the aluminum compound is a polyaluminum chloride compound or a polyaluminum hydroxide compound.

10. The producing method described in 8, wherein the aluminum compound is a compound represented by $$[Al_2(OH)_nCl_{6-n}]_m$$

or $$[Al(OH)_3]_1AlCl_3$$

wherein, n is an integer of from 0 to 6, m is an integer of from 1 to 8, and 1 is an integer of from 1 to 8.

DETAILED DESCRIPTION OF THE INVENTION

Figure 1:
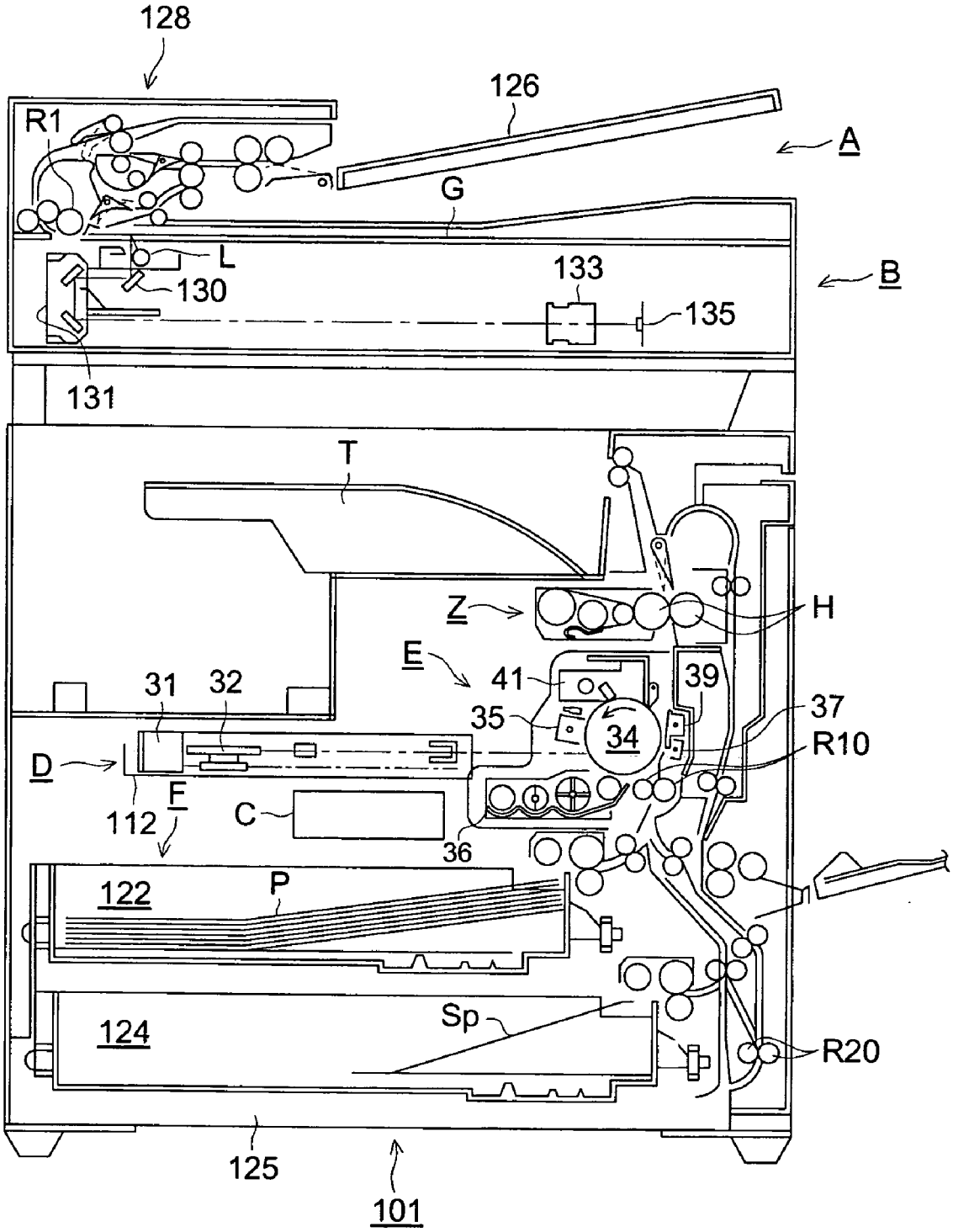
FIG. 1 is the cross section of an image forming apparatus showing an example of the image forming method using the toner according to the invention.

The inventors have found that the toner which at least contains the binder resin and the colorant and the binder resin is polyester resin or polyol resin, and the toner particle has aluminum content of from 0.007 to 0.140% by weight, chlorine content of from 0.002 to 0.412% by weight, an average value of the circular degree of from 0.94 to 0.99 and an average value of circle equivalent of from 2.6 to 7.4 μm, shows extreme high resolution equal to usual offset print and good fixing ability when the image is formed on thick paper and fixed by heating, moreover, the image formed by the toner does not cause contamination by rubbing even when the image is formed on paper for offset printing and the occurrence of toner blister is inhibited.

The toner according to the invention is produced by the following method: Aggregated particles having a specific shape is prepared by adding a poly-aluminum compound to a resin dispersion prepared by dispersing thermally molten polyester resin or polyol resin in an aqueous medium or a resin dispersion prepared by dispersing polyester resin or polyol resin dissolved in a solvent in an aqueous medium and then removing the solvent, and the aggregated particles are washed by water and dried to prepare toner particles, and then an external additive is added to the toner particles.

The toner according to the invention shows strong adhesiveness with the fibers of paper. Accordingly, good fixing ability can be obtained when the image is formed on thick paper and the contamination is prevented by rubbing together with the printed surfaces even when the image is formed on both sides of the smooth offset paper, and the good image without the toner blister can be obtained since the amount of impurity includable moisture is regulated.

Generally, a sufficiently fixed image is difficultly formed on the thick paper since the heat from the lower roller of a fixing device contacting to the back surface of the paper is difficultly conducted through the thick paper and the temperature at the interface of the toner and the paper is difficultly raised. The fixing strength can be easily obtained by sintering of the toner particles in the solid image. However, it is difficult to obtain a sufficiently fixed image in a halftone image since in such the image the density of the toner particles is low, and the toner particles cannot be sintered together with and the contacting area of the toner particle with the image receiving material per an image unit so that the toner particles are easily fallen down from the fibers.

If the slipping ability of the fixed toner is low, the toner is scoured by the fibers of paper and tends to be moved to the rubbing paper so as to tend to cause the contamination when the image faces of the offset paper with high smoothness are rubbed with together. However, fixed image surface using the toner according to the invention shows high slipping ability since the polyester resin or the polyol resin is used. Therefore, the rubbed surface is not contaminated when rubbed by the fibers. Besides, in the toner according to the invention, the adhesiveness of the toner is largely strengthen by nearing the surface energy according to controlling the aluminum concentration since aluminum sulfate used in the paper making process is remained at the surface of the paper for offset printing.

Moreover, in the toner according to the invention, the aggregating agent used in the production process can be easily removed by washing. Therefore, the amount of the aggregating agent remaining in the toner particle can be easily controlled.

When a solid black image is formed by a toner containing the aggregating agent in an amount exceeding a specific value and fixed by heating, the moisture taken by the aggregating agent is changed to water vapor and the vapor is passed through the toner layer of the toner layer of the solid black image, and the passing trace of the vapor makes a white spot like image defect or toner blister. However, in the toner according to the invention, the amount of the absorbed moisture is small and the toner blister is not formed in the fixed toner image since the content of the aggregating agent is controlled less than the specific value.

As above-mentioned, good fixing ability can be obtained and the toner blister at the solid black image can be prevented when the image is formed on the extreme thick paper and the offset printing paper by the use of the toner in which the specific binder resin and the amount of aluminum and that of chlorine contained in the toner are controlled and the shape of the toner particle is made to the specific shape.

Materials to be used in the toner are described below.

Binder Resin

A resin capable of forming a dispersion of resin particles in an aqueous medium is used as the binder resin constituting the toner. For example, amorphous polyester resin or polyol resin can be cited as the typical material.

Amorphous Polyester Resin

The amorphous polyester is resin in which polyester molecular having no clear crystal structure accounts for not less than 50 mole-percent of the whole resin constituting the toner. In more detail, the amorphous polyester is resin in which the molecules having a crystallization degree of less than 0.1% account for not less than 50 mole-percent.

The crystallization degree is determined by density, heat of fusion, X-ray diffraction, or NMR (nuclear magnetic resonance spectrum), and expressed by weight percentage of the crystallized domain.

Examples of polyvalent carboxylic acid to be used for the polyester resin include an aromatic dicarboxylic acid such as terephthalic acid, iso-phthalic acid, ortho-phthalic acid, 1,5-naphthalene-dicarboxylic acid, 2,6-naphthalene-dicarboxylic acid, diphenic acid, sulfoterephthalic acid, 5-sulfoisophthalic acid, 4-sulfophthalic acid, 4-sulfonaphthalene-2,7-dicarboxylic acid, 4-slfophthalic acid, 5[4-sulfophenoxy] isophthalic acid and their metal or ammonium salts, an oxycarboxylic acid such as p-oxy-benzoic acid and p-(hydroxyethoxy)benzoic acid, an aliphatic dicarboxylic acid such as succinic acid, adipic acid, azelaic acid, sebacic acid, and dodecane dicarboxylic acid, an unsaturated carboxylic acid such as fumalic acid, maleic acid, itaconic acid, hexahydrophthalic acid, and tetrahydrophthalic acid, and an alicyclic dicarboxylic acid. Other than the above, a tri- or more-valent carboxylic acid such as trimellitic acid, trimethic acid and pyromellitic acid can be exemplified.

Examples of poly-valent alcohol to be used for the amorphous polyester resin include aliphatic poly-valent alcohols, alicyclic poly-valent alcohol, and aromatic poly-valent alcohols. Aliphatic poly-valent alcohols such as ethylene glycol, propylene glycol, 1,3-propanediol, 2,3-butanediol, 1,4-butanediol, 1,5-pentanediol, 1,6-hexanediol, neopentyl glycol, diethylene glycol, dipropylene glycol, 2,2,4-trimethyl-1,3-pentanediol, polyethylene glycol, polypropylene glycol, and polytetramethylene glycol, and triols and tetraols such as trimethylolethane, trimethylolpropane, glycerol, and pentaerythrytol can be exemplified.

As the aromatic poly-valent alcohol, para-xylene glycol, meta-xylene glycol, ortho-xylene glycol, 1,4-phenylene glycol, ethylene glycol adducts of 1,4-phenylene glycol, bisphenol A, and ethylene oxide adducts of bis-phenol A can be exemplified. As the polyester polyol, lactone type polyester polyols can be exemplified, which are obtained by ring opening polymerization of lactones such as ϵ-caprolactone.

A mono-functional monomer may be introduced into the polyester for improving the stability regarding the atmosphere of the charging property of the toner by blocking the polar group being at the terminal of the polyester molecular. Examples of the usable mono-functional monomer include mono-carboxylic acids such as benzoic acid, chlorobenzoic acid, bromobenzoic acid, p-hydroxybenzoic acid, mono-ammonium sulfobenzoate, mono-sodium sulfobenzoate, cyclohexylaminocarbonylbenzoic acid, n-dodecylaminocarbonylbenzoic acid, t-butylbenzoic acid, naphthalene carboxylic acid, 4-methylbenzoic acid, 3-methylbenzoic acid, salicylic acid, thiosalycilic acid, phenylacetic acid, acetic acid, propionic acid, lactic acid, iso-lactic acid, octane carboxylic acid, lauric acid, stearic acid, and low alkyl esters of them, and mono-alcohols such as aliphatic alcohols, aromatic alcohols, and alicyclic alcohols.

Moreover, the polyester resin to be used in the invention may be urethane-modified polyesters which are each modified so that the molecular structure thereof includes a urethane linkage.

Polyol Resin

The following are preferable even though various types of polyol resin are usable.

It is preferred to use polyols each formed by reaction of epoxy resin, an alkylene oxide adducts or grycidyl ether thereof of di-valent phenol, a compound having one active hydrogen atom capable of reacting with an epoxy group and a compound having two or more active hydrogen atoms capable of reacting with an epoxy group. It is particularly preferable that the epoxy resin is a mixture of two or more kinds of bis-phenol A type epoxy resin each different from the others in the number average molecular weight. Such the polyol resins show high glossiness and transparency and are effective to anti-offset property.

The epoxy reins are preferably obtained by bonding of bis-phenol A or bis-phenol F with epichlorohydrin. For obtaining stable fixing ability and glossiness, it is preferable that the epoxy resin is composed of at least two kinds of bis-phenol A type epoxy resin each different from the other in the number average molecular weight and the number average molecular weight of the low molecular weight component is from 360 to 2000 and that of the high molecular weight component is from 3000 to 10000. Moreover, the content of the low molecular weight component is preferably from 20 to 50% by weight and that of the high molecular weight component is preferably from 5 to 40% by weight.

Examples of alkylene oxide adduct of di-valent phenol are shown below. Reaction products of ethylene oxide, propylene oxide, butylene oxide or a mixture of them with a bis-phenol such as bis-phenol A or bis-phenol F can be exemplified. Thus obtained adducts also may be used after glycidylized by epichlorohydrin or β-methylepichlorohydrin. Glycidyl ether of an alkylene oxide adduct of bisphenol A represented by the following Formula VI is particularly preferred.

Formula VI

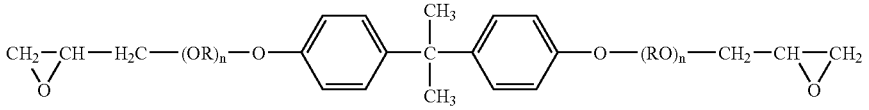

wherein, R is

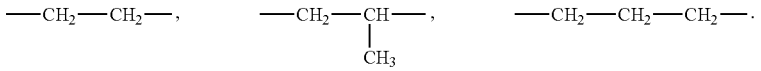

In the above formula, n and m are each the number of repeating unit and each represents 1 or more, and n+m is from 2 to 6.

It is preferable that the alkylene adduct of di-valent phenol or glycidyl ether thereof is contained in a ratio of from 10 to 40% by weight of the polyol resin.

When the amount of such the compound is too small, undesirable conditions such as increasing of curling are resulted and when n+m exceeds 7 or the amount is too large, the excessive high glossiness and possibility of degradation of the storage ability occur.

Examples of the compound having one active hydrogen atom capable of reacting with the epoxy group include mono-valent phenols, secondary amines and carboxylic acids.

As the mono-valent phenols, phenol, cresol, iso-propylphenol, aminophenol, nonyl phenol, dodecylphenol, xylenol and p-cumylphenol are exemplified. As the secondary amines, diethylamine, dipropylamine, dibutylamine, and N-methyl(ethyl)piperazine are exemplified. Examples of the carboxylic acid include propionic acid and caproic acid.

Various combinations of raw materials can be applied to obtain the polyol resin having the epoxy resin moiety and the alkylene oxide moiety in the main chain thereof. For example, the objective compound can be obtained by reacting epoxy resin having glycidyl groups at the both terminals thereof and alkylene oxide adduct of di-valent phenol having glycidyl groups at the both terminals thereof with a di halide compound, a di-isocyanate compound, a diamine compound, a dithiol compound, a poly-valent phenol compound or a di-carboxylic acid. Among them, the reaction with the di-valent phenol compound is most preferable from the viewpoint of stability of the reaction. It is also preferable that a poly-valent phenol compound or a poly-valent acid compound is used together with the di-valent phenol. The amount of the poly-valent phenol or the poly-valent carboxylic acid is not more than 15% by weight, and preferably not more than 10% by weight of the whole amount.

Examples of the compound having in the molecule thereof two or more active hydrogen atoms capable of reacting with the epoxy group include di-valent phenols, poly-valent phenols and poly-valent carboxylic acid. As the di-valent phenol, bis-phenols such as bis-phenol A and bis-phenol F are exemplified. Examples of the poly-valent phenol include o-cresol novolac, phenol novolac, tris(4-hydroxyphenyl)methane, and 1-[(α-methyl-α-(4-hydroxyphenyl)ethyl]benzene. As the poly-valent carboxylic acid, malonic acid, succinic acid, glutaric acid, adipic acid, fumalic acid, phthalic acid, terephthalic acid, trimellitic acid, and trimellitic anhydride are exemplified. It is preferable that the polyester resin or the polyol resin has no or weak crosslinking (THF insoluble ingredient is not more than 5%) since the transparency and the glossiness are difficultly obtained when the crosslinking density is excessively high.

The aggregating agent is preferably a polyaluminum compound.

Examples of the polyaluminum compound include poly(aluminum chloride) compounds, poly(aluminum hydroxide) compounds, poly(aluminum silicate) compounds, poly(aluminum fluoride) compounds, and poly(aluminum phosphate) compounds. Among them, poly(aluminum chloride) compounds having a number of aluminum atom of from 2 to 13, preferably from 3 to 8, poly(aluminum hydroxide), and poly(aluminum sulfate) compound having a number of aluminum atom of from 3 to 13, preferably from 4 to 8, are preferred.

Examples of the poly aluminum chloride are represented by the following Formula 1 or 2.

$$[Al_2(OH)_nCl_{6-n}]_m \quad \text{Formula 1}$$

$$[Al(OH)_3]_1AlCl_3 \quad \text{Formula 2}$$

In the above formulas, n is preferably an integer of from 0 to 6, m is preferably an integer of from 1 to 8, and 1 is preferably an integer of from 1 to 8.

Such the compounds are, for example, poly(aluminum chloride) and polyaluminum hydroxide which each stably contains a basic poly-nuclei condensed ion (polymerized substance) having high positive charge such as $[Al_6(OH)_{16}]^{3+}$ and $[Al_8(OH)_{20}]^{4+}$.

The polyaluminum compound as the aggregating agent is preferably added to the resin dispersion so that the concentration is reached to the critical aggregating concentration or more. The critical aggregating concentration is an indicator relating the stability of the aqueous dispersion and indicates the concentration of the aggregating agent necessary for occurring the aggregation. The critical aggregating concentration is largely varied depending on the emulsified component and the aggregating agent it self. The critical aggregating concentration is described in, for example, S. Okamura et al. "Kobunshi Kagaku" 17, 601, (1960) edited by Kobunshi Gakkai, and the detail of the critical aggregating concentration can be known by the above publication. In otherwise, the varied amounts of the salt to be used are added to the objective dispersion and the ζ-potential of the dispersion is measured. The concentration of the salt at which the potential is changed is determined as the critical aggregating concentration.

The aggregating agent relating to the invention is added so that the concentration of the aggregating agent exceeds the critical aggregating concentration, preferably 1.2 times or more, and more preferably 1.5 or more, of the critical aggregating concentration.

An aggregation stopping agent may be added to stop the aggregation. As the aggregation stopping agent, sodium hydroxide and sodium chloride can be cited.

The toner contains aluminum in an amount of from 0.007 to 0.140%, and preferably from 0.012 to 0.115%, by weight, and chlorine in an amount of from 0.002 to 0.412%, and preferably from 0.003 to 0.064%, by weight. Occurrence of the toner bluster can be inhibited, which is caused by bubbling of the moisture absorbed in the aluminum compound and the chlorine compound at the fixing by heat.

Sodium content in the toner particle is preferably controlled from 0.002 to 0.074%, and more preferably from 0.003 to 0.032%, by weight.

The amounts of aluminum, chlorine and sodium each taken into the toner particle from the compounds used as the aggregating agent, the aggregation stopping agent and the surfactant used as the dispersing aid for the colorant can be controlled by washing the aggregated particles.

The amounts of aluminum, chlorine and sodium can be measured by X-ray fluorescence spectroscopy (XRF), for example, wavelength dispersive XRF (WDX) or energy dispersive XRF (EDX), or atomic absorption spectrometry.

The production method of the toner is described below.

There is no limitation on the method for preparing the resin dispersion by dispersing particles of the polyester resin or the polyol resin in the aqueous medium. For example, a method by which the thermally molten resin is dispersed in the aqueous medium, and a method by which the resin dissolved in a solvent is dispersed in the aqueous medium and then the solvent is removed, are applicable.

The aggregation of the polyester resin particles or the polyol resin particles is performed by using the polyaluminum compound as the aggregating agent, and the aggregation can be stopped by adding the aggregation stopping agent according to necessity. The shape of the toner particle according to the invention can be obtained by controlling kind and mount of the aggregating agent, those of the aggregation stopping agent and the aggregating condition such as temperature and time. The shape of the toner particle according to the invention is as follows: the average value of the circular degree is from 0.94 to 0.99, the average circle equivalent diameter is from 2.6 to 7.4 μm and the inclination of the circular degree to the circle equivalent diameter is from −0.050 to −0.010.

The particles thus obtained are washed by water so that the contents of aluminum, chlorine and sodium are each made from 0.007 to 0.140% by weight, from 0.002 to 0.412% by weight, and from 0.002 to 0.074% by weight, respectively, and dried to prepare the toner particles. The washing is performed until the amounts of aluminum, chlorine and sodium are each within the above described ranges while sampling and measuring the amounts of the above substances in the course of the washing. The external additive relating to the invention, silica or titanium oxide having the diameter of primary particle of from 50 to 200 nm is finally added to the toner particle. Thus the toner is produced.

The shape of the toner is not varied even when the external additive is added.

The preparation of toner particle and the production of the toner are described below.

<Preparation of the Toner Using the Resin Dispersion Obtained by Dispersing the Thermally Molten Resin in the Aqueous Medium>

First process: A process for mixing, under a high pressure condition if necessary, a molten material prepared by thermally melting the toner raw material containing at least the polyester resin or the polyol resin and the aqueous medium heated by a temperature higher than the softening point Second process: A process for forming fine particles of the molten material by mechanically dispersing the mixture of the molten material and the high temperature aqueous medium while maintaining the temperature at the temperature higher than the softening point of the resin Third process: A process for preparing a fine particle dispersion by cooling the fine particle dispersion by a temperature lower than the softening point of the resin and the boiling point of water while preventing the adhesion together with the fine particles of the molten material Fourth process: A process for forming aggregated particles of the fine resin particle by adding the aggregating agent the resin fine particle dispersion, the aggregation stopping agent is added according to necessity, and adhering the aggregated fine particles Fifth process: A process for preparing toner particles by separating the aggregated particles from the aqueous medium, and washing and drying the separated particles <Preparation of Toner Particle from a Resin Dispersion Prepared by Dispersing the Resin Dissolved in a Solvent in an Aqueous Medium and Then Removing the Solvent>

First process: A process for synthesizing polyester resin or polyol resin

Second process: A process for preparing a solution by dissolving or dispersing a compound for toner containing at least the polyester resin or the polyol resin in a solvent Third process: A process for preparing a resin solution droplet dispersion by mechanically dispersing the solution in an aqueous medium and the removing the solvent Fourth process: A process for preparing the aggregated particle pf the fine particles of the resin by adding an aggregating agent according to the invention into the resin solution droplet dispersion to aggregate the fine droplets, and adding a polymerization stopping agent according to necessity, and then adhering the aggregated droplets by melting Fifth process: A process for preparing toner particles by separating the aggregated particles from the aqueous medium, and washing and drying the separated particles <Production of Toner by Mixing an External Additive>

This process is a process for producing the toner by adding the external additive into the above-prepared toner particles. As the apparatus for addition and mixing of the external additive, various known mixing apparatus such as a tabular mixer, a Henschel mixer, a Nauter mixer, and V-type mixer can be used. Among them, the Henschel mixer is preferable.

The shape of the toner particle is described below.

The shape of the toner particle according to the invention has the average value of the circular degree (the shape coefficient) represented by the following equation of from 0.94 to 0.99, more preferably from 0.94 to 0.98, and further preferably from 0.94 to 0.97. The average circular degree is determined concerning 2000 toner particles each having the diameter of not less than 1 μm are.

$$\text{Circular degree}=(\text{Periphery length of equivalent circle})/(\text{Periphery length of projection image of toner particle})=2\pi\times(\text{Projection area of particle}/\pi)^{1/2}/(\text{Periphery length of projection image of toner particle})$$

Wherein, the equivalent circle is a circle having an area the same as that of the projection image of the toner particle, and the circle equivalent diameter is the diameter of the equivalent circle.

The circular degree can be measured by FPIA, manufactured by Sysmex Corporation. The equivalent circle diameter id defined by the following equation.

$$\text{Equivalent circle diameter}=2\times(\text{Projection area of particle}/\pi)^{1/2}$$

In the shape of the toner according to the invention, the average of the equivalent circle diameter is from 2.6 to 7.4 μm and the inclination of the circular degree to the equivalent circle diameter is from −0.050 to −0.010. More preferably, the average of the equivalent circle diameter is from 3.4 to 6.6 μm and the inclination of the circular degree to the equivalent circle diameter is from −0.040 to −0.020.

Particles each having relatively high weight and low circular degree is transferred wedge wise and particles each having a smaller diameter and high circular degree are transferred so as to fill up the gaps between the larger particles and make the closest packing status for forming an image. The toner particles are sintered with together when such the image is fixed and satisfactory fixing strength can be obtained.

Such the effect is insufficient when the circular degree and the equivalent circle diameter of the particle scatteringly distribute.

It has been found that the sufficient fixing strength can be obtained on the thick paper by continuously changing the circle equivalent diameter and the circular degree according to the inclination of the circular degree to the circle equivalent diameter.

The inclination of the circle equivalent diameter is defined by α in the primary correlation (y=αx+b) of the relation between the circle equivalent diameter (μm) taken on the horizontal axis and the circular degree taken on the vertical axis, the circle equivalent diameter of the toner particle is measured by a flow type particle image analyzing apparatus FPIA-2000.

For improving the uniformity of electrical charge and that of the halftone image, $R^2$ (squared R) is preferably from 0.35 to 0.95. R is defined by the following formula 1.

$$R=A/B \qquad \text{Equation 1}$$

In the above, A and B are each defined by the following formulas.

$$A=n\Sigma XY-(\Sigma X\Sigma Y)$$

$$B=(n\Sigma X^2-(\Sigma X)^2)\times((n\Sigma Y^2)-(\Sigma Y)^2)$$

Wherein, X is circle equivalent diameter in μm, and Y is the circular degree.

Small diameter toner particles may be mixed with toner particles having a different shape and a lager diameter in some degree to prepare the toner having the inclination of circle equivalent diameter. In the later-mentioned method for producing the toner particles by aggregating resin particles, a method may be applied in which the stirring strength is controlled after addition of the aggregating agent by suitably selecting the shape of the stirring propeller so that the shearing force is easily applied to larger particles, and the resulted particles are filtered and dried. It is preferable that the toner producing apparatus is connected inline to the foregoing flow type particle image analyzing apparatus and the production is performed while monitoring the inclination α and suitably controlling the production conditions according to the result of the monitoring.

The shape of the toner particle can be controlled so as to be within the range of the invention when the particle is grown further 0.2 to 1.0 μm by re-addition of the aggregating agent or additional addition of a surfactant after the addition of the aggregating agent.

Colorant

As the colorant, various kinds of inorganic pigment, organic pigment and dye are usable.

Concrete examples of the inorganic pigment are listed below.

As a black pigment, for example, carbon black such as furnace black, channel black, acetylene black, thermal black, and lampblack, and a magnetic particle such as magnetite and ferrite are usable.

The inorganic pigments may be used singly or in combination of suitably selected ones. The adding amount of the inorganic pigment is from 2 to 20%, and preferably from 3 to 15%, by weight to the whole toner weight.

The magnetite may be added when the toner is used as a magnetic toner. In such the case, it is preferable that the adding amount is from 20 to 60% by weight for giving suitable magnetic properties.

Concrete examples of the organic pigment and the dye are show below.

As the pigment of magenta or red, the followings are exemplified: C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 122.

As the orange or yellow pigment, the followings are exemplified: C. I. Pigment Orange 31, C. I. Pigment Orange 43, C. I. Pigment Yellow 12, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155, and C. I. Pigment Yellow 156.

As the green or cyan pigment, the followings are exemplified: C. I. Pigment Blue 15, C. I. Pigment Blue 15:2, C. I. Pigment Blue 15:3, C. I. Pigment Blue 16, C. I. Pigment Blue 60, and C. I. Pigment Green 7.

As the dye, the followings are usable: C. I. Solvent Red 1, 49, 52, 58, 63, 111, and 122, C. I. Solvent Yellow 19, 44, 77, 79, 81, 82, 93, 98, 103, 104, 112, and 162, and C. I. Solvent Blue 25, 36, 60, 70, 93, and 95. A mixture of them is also usable.

These pigments and dyes may be used singly or in combination of suitably selected ones. The adding amount of the pigment is from 2 to 20%, and preferably from 3 to 15%, by weight to the whole weight of the toner.

The colorant may be modified on the surface thereof. A surface modifying agent such as a silane coupling agent, a titanium coupling agent and an aluminum coupling agent are preferably used.

Examples of the silane coupling agent include an alkoxysilane such as methyltrimethoxysilane, phenyltrimethoxysilane, methylphenyldimethoxysilane, and diphenyldimethoxysilane; a siloxane such as hexamethyldisiloxane; and γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane. Examples of the titanium coupling agent include products put on the market by Ajinomoto CO. Inc. with the commercial name of Plenact TTS, 9S, 38S, 41B, 46B, 55, 138S, or 238S, and the products put on the market by Nippon Soda CO., Ltd. with the commercial name of A-1, B-1, TOT, TST, TAA, TAT, TLA, TOG, TBSTA, A-10, TBT, B-2, B-4, B-7, B-10, TBSTA-400, TTS, TOA-30, TSDMA, TTAB or TTOP. Examples of the aluminum coupling agent include Plenact AL-M produced by Ajinomoto Co. Inc.

The adding amount of the surface modifying agent is preferably from 0.01 to 20%, and more preferably from 0.1 to 5%, by weight of the colorant. The surface modifying of the colorant particle can be performed by the following method: The surface modifying agent is added to a colorant particle dispersion and reacted by heating the mixture. The surface modified colorant particles thus obtained are filtered and repeatedly subjected to washing by the same solvent and filtration and dried to obtain the surface modified colorant.

Mold Releasing Agent

In the invention, it is preferable to contain wax to the toner for providing a suitable mold releasing ability to the toner. The wax is one having the melting point of from 40 to 120° C., preferably from 50 to 110° C.

It has been confirmed that the sufficient fixing ability, suitable anti-offset property and durability can be obtained even when the fixing temperature is set at a low level by the use of the wax having the melting point within the above-mentioned range.

The melting point of the wax can be determined by differential scanning calorimetry (DSC) The melting point is defined by the peak value of melting when several milligram of the sample is heated with a constant temperature raising rate, for example 10° C./minute.

As the mold releasing agent, carnauba wax, low molecular weight polypropylene having an average molecular weight of from 1500 to 9000 and low molecular weight polyethylene are preferable. Ester compounds represented by the following formula are particularly preferred.

$$R_1—(OCOR_2)_n$$

In the formula, n is an integer of from 1 to 4, preferably from 2 to 4, further preferably from 3 to 4, and most preferably 4. $R_1$ and $R_2$ are each a carbon hydride group which may have a substituent. The number of the carbon atoms of $R_1$ is preferably 1 to 40, more preferably from 1 to 20, and further preferably from 2 to 5. The number of the carbon atoms of $R_2$ is preferably 1 to 40, more preferably from 16 to 30, and further preferably from 18 to 26.

Crystallinity polyester can also be used as the mold releasing agent. As the crystallinity polyester, polyester obtained by reaction of an aliphatic diol with an aliphatic dicarboxylic acid (including acid anhydride and acid chloride) is preferred.

Examples of the diol to be used for obtaining the crystallinity polyester include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexanediol, 1,4-cyclohexane diol, 1,4-cyclohexanedimethanol, dipropylene glycol, polyethylene glycol, polypropylene glycol, polytetramethylene glycol, bis-phenol A, bis-phenol Z, and hedrogenated bis-phenol A.

Examples of the dicarboxlic acid to be used for obtaining the crystallinity polyester include oxalic acid, malonic acid, succinic acid, glutaric acid, adipic acid, pimelic acid, suberic acid, azelaic acid, sebacic acid, acid, fumalic acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octynylsuccinic acid, n-octenylsuccinic acid, and acid anhydride and acid chloride thereof.

As the particularly preferred crystallinity polyester, one obtained by reaction of 1,4-cyclohexanedimethanol with adipic acid, one obtained by reaction of 1,6-hexanediol with sebacic acid, one obtained by reaction of ethylene glycol with sebacic acid, and one obtained by reaction of 1,4-butanediol and succinic acid can be exemplified. The polyester obtained by reaction of 1,4-cyclohexanedimethanol with adipic acid is most preferred.

The adding amount of the foregoing compound is from 1 to 30%, preferably from 2 to 20%, further preferably from 3 to 15%, by weight of the whole toner.

Charge Controlling Agent

Examples of the charge controlling agent include nigrosin type dyes, triphenylmethane type dyes, chromium-containing metal complex dyes, molybdate chelate pigments, Rhodamine type dyes, alkoxyl amines, quaternary ammonium salts including fluorine-modified quaternary ammonium salts, alkylamides, elemental phosphor and its compounds, elemental tungsten and its compounds, fluorine-containing surfactants, metal succinate and metal salts of succinic acid derivative. In concrete, nigrosin type dye Bontron 03, quaternary ammonium salt Bontron P-51, azo type metal complex compound Bontron S-34, oxynaphthoic type metal complex E-89, salicylic acid type metal complex E-84, and phenol type condensation product E-89, each produced by Orient Chemical Industries, Ltd., quaternary ammonium salt molybdenum complex TP-302 and TP-415, each produced by Hodogaya Chemical Co., Ltd., quaternary ammonium salt Copycharge PYS VP2038, triphenylmethane derivative Copyblue PR, quaternary ammonium salt Copycharge NEGVP2036, and Copycharge NX V434, each produced by Hoechst CO., Ltd., LRA-901, and boron complex LR-147, each produced by Japan Carlit Co. Ltd., copper phthalocyanine, perylene, quinacridone, azo type pigments, and polymers having a functional group such as a sulfonic acid group, a carboxyl group and quaternary ammonium salt group. Among them, azo type metal complex compounds are preferred. For example, ones disclosed in paragraph 0009 to 0012 of JP O.P.I. Publication No. 2002-351150 are preferably used.

In the invention, the charge controlling agent is preferably used in an ratio of from 0.1 to 10 parts by weight to 100 parts by weight of the binder resin even though the amount of the agent cannot be simply decided since the amount is decided depending on the kind of the binder resin, presence of additive to be added according to necessity, and the producing process of the toner including the dispersing method.

In the invention, it is preferable to add the charge controlling agent to near the surface of the toner particle. The charging property can be effectively given to the toner particle and the flowing ability of the toner can be maintained by adding the charge controlling agent to near the surface of the toner particle since the charge controlling agent is added so that the charge control agent is not exposed to the toner surface.

As the concrete adding method, for example, a method can be applied by which the amount of the charge controlling agent to be added to the resin particle constituting the toner particle. Such the method includes a method by which more amount of the charge controlling agent is added to the resin particle for constituting the near surface of the toner particle and the resin particles are aggregated so that the surface of the toner particle is constituted by resin particles containing no charge controlling agent, and a method by which the resin particles containing are aggregated and then thus prepared aggregated particles are each cupseled by a resin component containing no charge controlling agent on the surface thereof.

It is preferable as the method for adding to the interior of the resin particle to mix the charge controlling agent with the binder resin and to control the diameter of the dispersed particles of the binder resin. However, the charge controlling agent may also be added into the aqueous phase so as to be taken into the toner in the aggregating process or the drying process when the charge controlling agent is dissolved out or released to the aqueous phase side.

Developer

The toner according to the invention may be applied in either a single component developer or a two component developer. When the toner is used as the single component developer, the developer may be either a non-magnetic single component developer or a magnetic single component developer in which the toner particle contains magnetic particles having a diameter of from 0.1 to 0.5 μm.

The toner particle may be used as a two-component developer by mixing with carrier. In such the case, a metal such as iron, ferrite, and magnetite, and an alloy of such the metals and another metal such as aluminum and lead can be used as the magnetic particle of the carrier. The ferrite particle is preferred. The foregoing magnetic particle is preferably one having a volume average particle diameter of from 15 to 100 μm, and more preferably from 25 to 80 μm.

The volume average particle diameter can be measured by laser diffraction type particle size distribution measuring apparatus HELOS, manufactured by Sympatec GmbH, having a wet type dispersing device.

A carrier in which the magnetic particle is coated with resin and a carrier in which the magnetic particle is dispersed in the resin so-called as resin dispersion type carrier are preferred. As the coating resin, for example, olefin type resins, styrene type resins, styrene-acryl type resins, silicone type resins, ester type resins or fluorine-containing resins are usable even though there is no limitation on the composition of the coating resin. As the resin for constituting the resin dispersion type carrier, for example, styrene-acryl type resins, polyester resins, fluorine-containing resins and phenol resins can be used.

External Additive

An inorganic fine particle is preferably used as the external additive for improving the flowing ability, developing ability and charging ability of the toner particle. The primary particle diameter of the inorganic fine particle is preferably from 5 to 2,000 nm, and particularly preferably from 50 to 200 nm. The size of the inorganic particle can be measured by a transmission electron microscope or a field-effect scanning electron microscope.

The specific surface area by BET method of the inorganic fine particle is preferably from 20 to 500 $m^2$. The adding ratio of the inorganic fine particles is preferably from 0.01 to 5% by weight, and particularly preferable from 0.01 to 2.0% by weight.

Concrete examples of the inorganic fine particle include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, red ion oxide, antimony trioxide, magnesium oxide, zirconium oxide, barium sulfate, barium carbonate, silicon carbide, and silicon nitride. Silica and titanium type fine particle are particularly preferred.

The silica or titanium oxide fine particle to be used in the invention is preferably hydrophobilized by a silane coupling agent or titanium coupling agent. The hydrophobic degree of the fine particle is preferably from 40 to 95 by methanol wettability even though there is no limitation on the degree of the hydrophobilizing treatment. The methanol wettability shows wetting ability of the particle to methanol. The measuring method of the methanol wettability is as follows: To 50 ml of distilled water in 200 ml beaker, 0.2 gram of the inorganic fine particle to be measured is added. Methanol is gradually added from a buret, the lower end of which is immersed into the liquid in the beaker until the whole of the inorganic fine particles is wetted while slowly stirring. The hydrophobic degree is calculated by the following equation according to the amount of methanol A ml necessary for completely wetting the inorganic fine particles.

$$\text{Hydrophobic degree}=[A/(A+50)]\times 100\%$$

The adding amount of the external additive is preferably from 0.1 to 5.0%, and more preferably from 0.5 to 4%, by weight.

Other than the above, fine particle of polymer such as methacrylate polymer, methacrylate copolymer prepared by soap-free emulsion polymerization or dispersion polymerization, condensation polymerized polymer such as silicone, benzoguanamine, and nylon, and polymer particle of thermally hardenable resin are usable.

The degradation of the fluidity and the charging ability under a high humidity can be prevented by such the flow improving agent when the hydrophobilicity of the agent is raised by a surface treatment.

As a cleaning ability improving agent for removing the developer remained on the photoreceptor or the primary transferring medium after the image transfer, for example, a metal salt of fatty acid such as zinc stearate, and calcium stearate, a polymer fine particle prepared by soap-free emulsion polymerization such as fine particle of poly(methyl methacrylate), and that of polystyrene are usable. Preferable polymer fine particle has relatively narrow particle size distribution and a volume average particle size of from 0.01 to 1 μm.

The image forming apparatus, image forming method, and image receiving material are described below.

FIG. 1 shows the cross section of an image forming apparatus as an example of the image forming apparatus using the toner according to the invention.

The image forming apparatus 101 has an automatic original feeding device A, so-called ADF, an original image reading device B, an image processing card C for processing the read image, a writing device D including a writing unit 112 by which an image is written on a photoreceptor drum 34 as an image carrier according to the image data after the processing, Image forming device E including image forming means such as a developing device 36, a transferring device 37, a separation device 39 and cleaning device 41, and a Stocking device F for receiving paper supplying trays 122 and 124 containing recording paper P.

The automatic original feeding device A is principally constituted by an original feeding device 128 including an original standing table 126, a group of roller including R1, and a feeding course changing means (with no reference number).

The original image reading device B is positioned under a platen glass G and constituted by two mirror units 130 and 131 capable of going and returning while maintaining the optical pass length, a fixed imaging lens 133, hereinafter referred to as lens, and a line shaped imaging element 135, hereinafter referred to as CCD. The writing device D includes a laser light source 31 and a polygon mirror 32.

R10 shown before the transferring device 37 with respect to the moving direction of the recording paper P as the image receiving material is a register roller, and H shown at the down stream of the separating means 39 is a fixing device.

In the embodiment, the fixing device H is constituted by a heating roller in which a heat source is built and a pressure roller rotating while contacting by pressure with the heating roller.

Z is a cleaning means for the fixing device H. The principal element of Z is a cleaning web which is installed so as to be wound up.

One of originals (not shown in the figure) stood on the original standing table 126 is fed by the original feeding device 128 and lighted by a lighting means L while passing under the roller R1.

Reflected light from the original is focused on the CCD 135 through the mirror units 130 and 131 at the fixed position and the lens 133, and read.

The image information read by the original image reading device B is processed by the image processing means and stored in a memory provided on the image processing card C.

The image information is called according to the image formation, and the laser light source 31 of the writing device is driven and light exposure is given onto the photoreceptor drum 34 according to the image information.

Recently, research and development on an image forming method using a digital system is vigorously progressed in the field of the electrophotography in which an electrostatic image is formed on a photoreceptor and the latent image is developed to form a visible image. By the digital system, improvement, variation and editing of the image can be easily performed and a high quality image can be obtained.

As the optical scanning system for modulating light according to digital image information from the computer or the original to be copied, which is used in such the image forming method and apparatus, an apparatus in which a sonic optical modulation device is stood in the optical pass and the light is modulated by the sonic optical modulation device and an apparatus in which intensity of the laser light is directly modulated by the use of a semiconductor laser are used. The uniformly charged photoreceptor is spot wise exposed to light by such the scanning optical system to form a dot image.

The light beam irradiated from the foregoing optical scanning system has a circular shaped or oval shaped intensity distribution approximated with a regular distribution extending at the bottom. For example, in the case of the laser beam, the shape of the beam is generally extremely narrow circle or oval such as that the length in both or one of the main scanning direction and the sub-scanning direction is from 20 to 100 μm on the photoreceptor surface.

The toner according to the invention is suitably used in the image forming method including a fixing process in which the support carrying the image is fixed by passing between the heating roller and the pressing roller.

Figure 2:
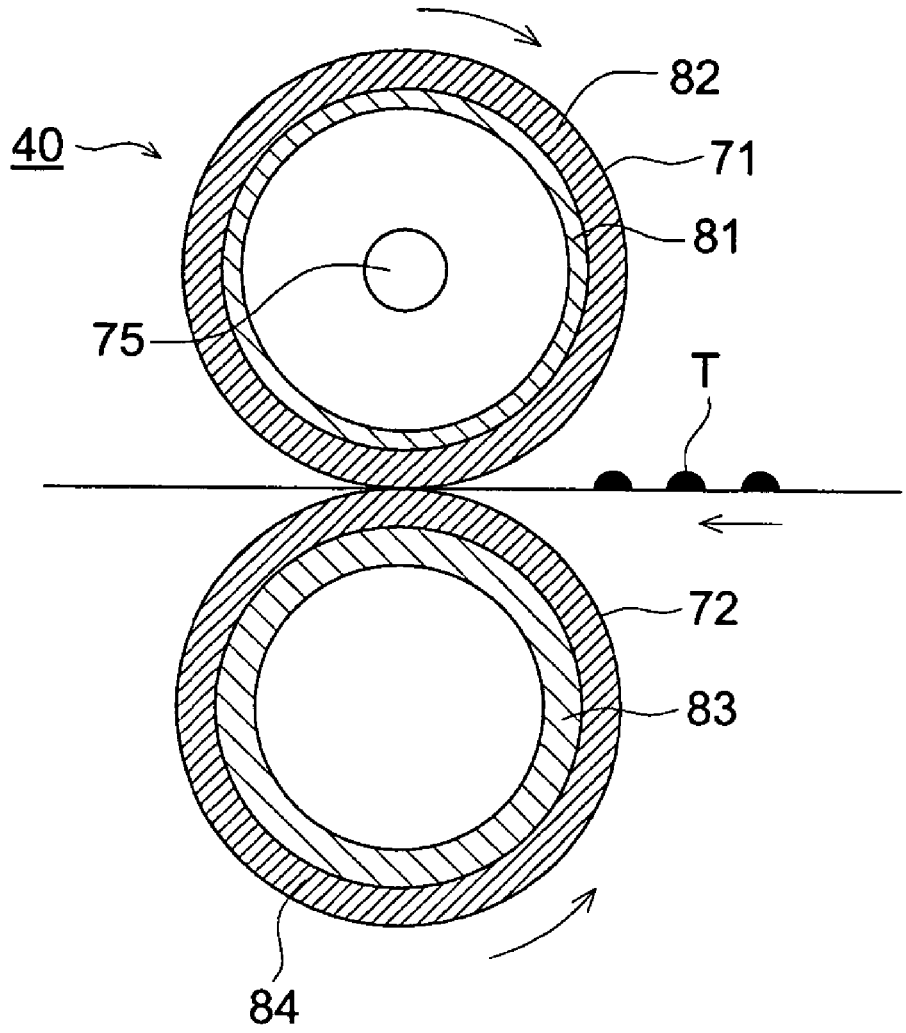
FIG. 2 is a cross section showing an example of fixing device to be used in the image forming method using the toner according to the invention.

FIG. 2 shows the cross section of an example of fixing device to be used in the image forming method using the toner according to the invention.

The fixing device 40 has a heating roller 71 and a pressing roller 72 contacting with the heating roller. In FIG. 2, T is the toner image formed on the image receiving material or image supporting material.

The heating roller 71 is constituted by a metal core 81 and a covering layer 82 composed of fluororesin or elastic material covering the surface of the metal core, and the heating roller includes a heating means 75 of a linear heater.

The metal core 81 is composed of metal and has a diameter from 10 to 70 mm. As the metal of the metal core is, for example, iron, aluminum, copper and their alloy may be used even though the kind of metal is not limited.

The thickness of the metal core 81 is from 0.1 to 15 mm, which is decided by considering on the balance between the requirements of energy saving by reducing the thickness and the strength depending on the constituting material. For example, a thickness of 0.8 mm is required for the aluminum core to obtain the strength the same as that of the iron core having a thickness of 0.57 mm.

As the fluororesin constituting the covering layer 82, polytetrafluoroethylene (PTFE) and tetrafluoroethylene-perfluoroalkyl vinyl ether copolymer (PFA) can be exemplified.

The thickness of the covering layer 82 composed of the fluororesin is from 50 to 700 μm, and preferably from 70 to 600 μm.

As the heating means, a halogen heater is suitably used.

The pressing roller 72 is constituted by a metal core 83 and a covering layer 84 composed of an elastic material covering the metal core. There is no limitation on the elastic material composing the covering layer 84. Various kinds of soft rubbed such as urethane rubber and silicone rubber, and silicone sponge are usable. The use of the silicone rubber and silicone sponge are preferably used.

The Ascar hardness of the elastic material composing the covering layer 84 is from 40 to 80°, and preferably from 45 to 75°, more preferably from 55 to 70°.

The thickness of the covering layer 84 is from 0.1 to 30 mm, and preferably from 0.1 to 20 mm.

As the metal of the metal core is, for example, iron, aluminum, copper and their alloy may be used even though there is no limitation on the kind of metal.

The contacting load (the total load) is usually from 40 to 350 N, preferably from 50 to 300 N, and more preferably from 50 to 250 N. The contacting load is decided considering the strength or the thickness the metal core 81. For example, the load is preferably 250 N or less for a heating roller having a metal core composed of 0.3 mm of iron.

The width of the nipping is preferably from 4 to 10 mm from the view point of the anti-offset ability and the fixing ability. The face pressure at the nipping is preferably from $0.6\times10^5$ Pa to $q.5\times10^5$ Pa.

An example of condition of the fixing by the fixing device shown in FIG. 2 is the fixing temperature or the surface temperature of the heating roller 71 is from 150 to 210° C. and the line speed of fixing is from 230 to 900 mm/sec.

A cleaning mechanism may be attached to the foregoing fixing device. A method by which a silicone oil is supplied to the fixing film, or a method by which the cleaning is performed by a pad, a roller or a web each soaked with a silicone oil are applicable for the cleaning.

Polydimethylcyloxane, polymethylphenylcyloxane and polydiphenylcyloxane may be used as the silicone oil, siloxane containing fluorine is suitably used.

The image forming apparatus used in the invention may be one having a toner recycling mechanism by which the toner not transferred and remained on the photoreceptor surface is recycled for reuse. The method for toner recycling is not specifically limited. Examples of the recycling method include a method by which the toner recovered in the cleaning device is conveyed by a conveyer or conveying screw to a toner supplying hopper, developing device or the toner is supplied to the developing device after mixed with the toner to be newly supplied in an intermediate chamber. The method to directly return the recovered toner to the developing device and the method to supply the recovered toner after mixing with the newly supplying toner are preferably applied.

Image Receiving Material

As the image receiving material, a thick paper sheet, a thin paper sheet, a paper sheet with high surface smoothness, a paper sheet with low surface smoothness and an OHP film sheet may be used without any limitation.

As example of the extreme thick paper, post card with a thickness of 0.4 mm, manufactured by Heart Co., Ltd., as that of paper with high surface smoothness, non-coated medium quality paper "Paper for paperbacks" for offset printing having a weight of 60.2 g/m$^2$ and a smoothness of 22 seconds, and a high quality paper sheet with a weight of 64 g/m$^2$ usually used for electrophotographic copy, can be cited.

EXAMPLES

The invention is described below referring examples. In the below-mentioned, "part" is part by weight, and % is % by weight.

Example 1

<Preparation of Resin Solution 1>

In a reaction vessel having a cooler, a stirrer and a nitrogen introducing tube, 343 parts of adduct of bis-phenol A and 2 moles of ethylene oxide, 166 parts of iso-phthalic acid and 2 parts of dibutyl phthalate are put, and reacted for 8 hours at 230° C. under an ordinal pressure, and further reacted for 5 hours under a reduced pressure of from 10 to 15 mmHg (from 1.33 to 1.99 Pa) and then cooled by 110° C. Then 17 parts of isoborondiisocyanate was added in toluene and reacted for 5 hours at 110° C., and the solvent was removed. Thus Urethane-modified Polyester 1 was obtained, which has a weight average molecular weight of 72.000 and a free isocyanate content of 0.7%. Besides, 570 parts of adduct of bis-phenol A and 2 moles of ethylene oxide and 217 parts of terephthalic acid were condensed-polymerized for 6 hours at 230° C. in a manner similar to the above-mentioned. Thus unmodified Polyester 1 with a number average molecular weight of 2.400, a hydroxide group value of 51 and an acid value of 5. In 2,000 parts of ethyl acetate, 200 parts of Urethane-modified Polyester 1 and 800 parts of Polyester 1 were dissolved and mixed to obtain Resin Solution 1. The Tg of the resin component in the Resin Solution 1 was 64° C.

Preparation of Toner Particle 1

| | |
|---|---|
| Resin Solution 1 | 100 parts |
| Carbon black | 12 parts |
| Charge controlling agent TP-302 (Hodogaya Kagaku Co., Ltd. | 1 part |
| Carnauba wax | 10 parts |

The above materials were dispersed in 200 parts of toluene by a ball mil filled by zirconia beads to prepare Oil Phase 1 to be made as a dispersed phase.

Separately, the following composition was stirred and dispersed to prepare Aqueous Phase 1 to be made as a continuous phase.

| | |
|---|---|
| Ion exchanged water | 700 parts |
| Sodium dodecylbenzenesulfonate | 1 part |

Into Aqueous Phase 1, Oil Phase 1 was added while stirring by Homomixer, Manufactured by Tokushu Kika Kogyo Co., Ltd., to prepare Oil Droplet 1 having a volume average diameter of 1 μm by controlling the rotation number of stirring. Then toluene was removed by distillation at 50° C. under a reduced pressure. Thus black Dispersion 1 was obtained.

Dispersion 1 was moved into a stirring tank having an impellor, and Aqueous Solution 1 composed of 90 parts of ion exchanged water and 10 parts of aluminum chloride $[Al_2(OH)_4Cl_2]_2$ dissolved in the water was gradually dropped while stirring with low speed to form aggregated particles. The temperature of the liquid was maintained at 70° C. and a part of the liquid was samples and partial fusion-adhering of the aggregated particle was confirmed by a scanning electron micrometer.

The liquid was stirred for 8 hours at 95° C. until the circular degree of the aggregated particle was become 0.963, then the temperature was lowered by 40° C. and stirring was stopped.

Thereafter filtration and washing of the particles were repeated and black Toner Particle 1 was obtained. The circular degree of the particles was further raised by the drying.

Mixing with External Additive

One hundred parts of thus obtained Toner Particle 1, 0.8 parts of needle shaped titanium oxide which has a major axis diameter of 120 nm and is treated by decyltrimethoxysilane, 1.8 parts of spherical monodispersed silica and 0.3 parts of hydrophobic were mixed for 15 minutes by a Henschel mixer with a circumference speed of 30 m/s. The spherical monodispersed silica was one having a particle diameter of 137 nm which was prepared by HMDS treating, drying and powdering silica sol obtained by a sol-gel method, and the hydrophobic silica is one having a particle diameter of 14 nm which was prepared by a gas phase method and treated by octylmethoxysilane. The mixture was sieved by a sieve having an opening of 45 μm to remove coarse particles. Thus Toner 1 was prepared. The shape and the particle diameter of the toner were not varied by the addition of the external additive.

Example 2

Toner 2 was prepared in the same manner as in Example 1 except that the poly(aluminum chloride) $[Al_2(OH)_4Cl_2]_2$ was replaced by $[Al_2(OH)_2Cl_2]_3$.

Example 3

Toner 3 was prepared in the same manner as in Example 1 except that the poly(aluminum chloride $[Al_2(OH)_4Cl_2]_2$ replaced by $[Al_2(OH)_6]_8$.

Example 4

Toner 4 was prepared in the same manner as in Example 1 except that the polyaluminum chloride $[Al_2(OH)_4Cl_2]_2$ was replaced by aluminum chloride.

Example 5

Toner 5 was prepared in the same manner as in Example 1 except that the polyaluminum chloride $[Al_2(OH)_4Cl_2]_2$ was replaced by magnesium chloride.

Example 6

Toner 2 was prepared in the same manner as in Example 1 except that the polyaluminum chloride $[Al_2(OH)_4Cl_2]_2$ was replaced by zinc sulfate.

The aluminum content, the chlorine content, the sodium content were measured via WDX.

The aluminum content, the chlorine content, the sodium content, the average value of circular degree, the average content, the circular degree concerning the circle equivalent diameter of the obtained toner were listed in Table 1.

TABLE 1

| Example | Toner No. | Aggregating agent | Aluminum content (weight-%) | Chlorine content (weight-%) | Sodium content (weight-%) | Average circular degree | Average of circle equivalent diameter (μm) | Circular degree concerning circle equivalent diameter | Remarks |
|---|---|---|---|---|---|---|---|---|---|
| 1 | 1 | $(Al_2(OH)_4Cl_2)_2$ | 0.056 | 0.044 | 0.032 | 0.986 | 5.1 | −0.022 | Inv. |
| 2 | 2 | $(Al_2(OH)_2Cl_4)_3$ | 0.009 | 0.007 | 0.004 | 0.982 | 3.4 | −0.014 | Inv. |
| 3 | 3 | $(Al_2(OH)_6)_8$ | 0.127 | 0.087 | 0.068 | 0.958 | 7.3 | −0.047 | Inv. |
| 4 | 4 | Aluminum chloride | 0.180 | 0.447 | 0.089 | 0.942 | 5.4 | −0.002 | Comp. |
| 5 | 5 | Magnesium chloride | 0.000 | 0.482 | 0.001 | 0.941 | 5.5 | −0.052 | Comp. |
| 6 | 6 | Zinc sulfate | 0.000 | 0.001 | 0.001 | 0.932 | 5.6 | −0.048 | Comp. |

Inv.; Inventive
Comp.; Comparative

Preparation of Developer

Each of Toners 1 through 6 prepared as above was mixed with a manganese-ferrite carrier of silicone coated 60 μm by Henschel mixer. Thus Developers 1 through 6 each having a toner concentration of 6% by weight was prepared.

Evaluation

Developers 1 through 6 were set in due order in an electrophotographic digital multifunction copying machine Sitios 7075HV, manufactured by Konica Corp., and printing was performed using Toners 1 through 6 under conditions of a temperature of 20° C. and a relative humidity of 50%. The evaluation was carried out with respect to the following items.

<Fixing Ability on Extra Thick Card Such as a Thick Post Card>

On 500 sheets of thick post card having a thickness of 0.4 mm, an image having a gray colored frame is continuously printed. The frame had a density of 0.5. The fixing status of the $500^{th}$ printed car was evaluated according to the following norms.

Evaluation Norm

A: Toner was not fallen at all even when a letter was written on the gray frame by a pen with strong force. Fixed status was very good.

B: Toner was fallen when a letter was written by a pen but not fallen when the letter was written by strong force by a ball-point pen. Fixed status was good.

C: Fingers were contaminated by the toner when the part of the gray frame of the card was only handled since fixing was insufficient. Fixing status was poor and not suitable for practical used.

<Fixing Ability on Offset Printing Paper Such as "Paper for Paperbacks">

On 250 sheets of paper for offset printing "Paper for Paperbacks" with a weight of 60.2 g/m$^2$, manufactured by Daio Seishi Co, Ltd., character images were continuously printed. The last 10 sheets of the print were turned over by thumb of one hand and the contamination around the characters by spreading of toner was observed.

Evaluation Norm

A: Spreading contamination was not observed at all. The fixed status is good without any problem.

B: The contamination cannot be visibly observed but slightly recognized by observation through a loupe. It is confirmed by an electron microscope that the toner layer at the surface was lacked. No problem was raised in the practical use.

C: The trace of the finger was contaminated as like as dark spreading. Fixing ability was poor and unacceptable for practical use.

<Toner Blister>

The printing process was controlled so that the adhered amount of toner on the ordinary paper with a weight of 64 g/m$^2$ was to be 1.6 mg/cm$^2$ and a printed image was made. The presence of the toner blister, a hole with diameter of from 0.1 to 0.5 mm in the toner image, was observed by a microscope for evaluation.

Evaluation Norm

A: Toner blister was not observed without any problem.

B: There are 1 to 2 toner blisters per 4 cm$^2$ but no problem was raised since the blister is only recognized by stare.

C: Three or more apparent blisters per 4 cm$^2$ were observed. It is problem for practical use.

Results of the evaluation on the fixing ability on the extra thick post card, that on the offset printing paper and the toner blister are listed in Table 2.

TABLE 2

| Toner No. | Fixing ability on extra thick post card | Fixing ability on offset printing paper | Toner blister | Remarks |
|---|---|---|---|---|
| 1 | A | A | A | Inventive |
| 2 | A | A | A | Inventive |
| 3 | A | A | A | Inventive |
| 4 | B | C | C | Comparative |
| 5 | C | C | C | Comparative |
| 6 | C | C | C | Comparative |

As is shown in Table 2, Toners 1 through 1 to 3 according to the invention are all good results with respect to each of the evaluation items, but the comparative Toners 4 through 6 raise problem in any one of the evaluation items of the fixing ability on extra thick post card, the fixing ability on offset printing paper and the toner blister.

As is proved in the examples, the toner and the production method thereof provide excellent effects that good fixing result can be obtained when a toner image is formed on an image receiving material even if the material is one having extreme large thickness and high resistivity to rubbing can be obtain even when the high smoothness paper is used as the image receiving material, and the toner blister not occur.

The invention claimed is:

1. A toner for developing an electrostatic image comprising toner particles containing a colorant and a binder resin containing a polyester resin or a polyol resin, wherein the toner particles contain an aluminum compound and a chlorine compound, a content of aluminum in the aluminum compound being from 0.007 to 0.140% by weight as an aluminum atom based on the total weight of the toner particles, and a content of chlorine in the chlorine compound being from 0.002 to 0.412% by weight based on the total weight of the toner particles, and the toner particles have an average circular degree of from 0.94 to 0.99 and an average circle equivalent diameter of from 2.6 to 7.4 μm.

2. A toner of claim 1, wherein the content of aluminum in the aluminum compound is from 0.012 to 0.115% by weight based on the total weight of the toner particles.

3. A toner of claim 1, wherein the content of chlorine in the chlorine compound is from 0.003 to 0.064% by weight based on the total weight of the toner particles.

4. A toner of claim 1, wherein the toner particles contain a sodium compound, a content of sodium in the sodium compound being from 0.002 to 0.74% by weight based on the total weight of the toner particles.

5. The toner of claim 4, wherein the inclination of the circular degree to a circle equivalent diameter of the toner particle is from −0.050 to −0.010.

6. The toner of claim 1, wherein the inclination of the circular degree to a circle equivalent diameter of the toner particle is from −0.050 to −0.010.

7. The toner of claim 1, wherein the toner further comprises particles of silica or titanium oxide having a primary particle diameter of from 50 to 200 nm.

8. The toner of claim 1, wherein the binder resin comprises an amorphous polyester resin.

9. A producing method of the toner of claim 1, which comprises:

aggregating polyester resin particles or polyol resin particles dispersed in an aqueous medium by employing an aluminum compound.

10. The producing method of claim 9, wherein the aluminum compound is a polyaluminum chloride compound or a polyaluminum hydroxide compound.

11. The producing method of claim 9, wherein the aluminum compound is a compound represented by $$[Al_2(OH)_nCl_{6-n}]_m$$

or $$[Al\ (OH)_3]_1AlCl_3$$

wherein, n is an integer of from 0 to 6, m is an integer of from 1 to 8, and 1 is an integer of from 1 to 8.

12. A toner for developing an electrostatic image comprising toner particles containing a colorant and a binder resin containing a polyester resin or a polyol resin, wherein a content of aluminum in the toner is from 0.007 to 0.140% by weight as an aluminum atom based on the total weight of the toner particles, and a content of chlorine in the toner is from 0.002 to 0.412% by weight based on the total weight of the toner particles, and the toner particles have an average circular degree of from 0.94 to 0.99 and an average circle equivalent diameter of from 2.6 to 7.4. mu.m.

13. A toner of claim 12, wherein the content of aluminum in the toner is from 0.012 to 0.115% by weight based on the total weight of the toner particles.

14. A toner of claim 13, wherein the content of chlorine in the toner is from 0.003 to 0.064% by weight based on the total weight of the toner particles, wherein a content of sodium in the toner is from 0.002 to 0.074% by weight based on the total weight of the toner particles, and wherein the inclination of the circular degree to a circle equivalent diameter of the toner particle is from −0.050 to −0.010.

15. A toner of claim 12, wherein the content of chlorine in the toner is from 0.003 to 0.064% by weight based on the total weight of the toner particles.

16. A toner of claim 12, wherein a content of sodium in the toner is from 0.002 to 0.074% by weight based on the total weight of the toner particles.

17. A toner of claim 12, wherein the inclination of the circular degree to a circle equivalent diameter of the toner particle is from −0.050 to −0.010.

* * * * *